United States Patent [19]

Mölders

[11] Patent Number: 4,862,766

[45] Date of Patent: Sep. 5, 1989

[54] DEVICE FOR DRIVING A CAN PLATE OF A SPINNING PREPARATION MACHINE

[75] Inventor: Franz Mölders, Ebersbach/Fils, Fed. Rep. of Germany

[73] Assignee: Zinser Textilemaschinen GmbH, Fed. Rep. of Germany

[21] Appl. No.: 103,446

[22] Filed: Sep. 30, 1987

[30] Foreign Application Priority Data

Oct. 1, 1986 [DE] Fed. Rep. of Germany ..... 3633429

[51] Int. Cl.[4] ..... F16H 37/06; F16H 35/00; F16H 57/00; D04H 11/00

[52] U.S. Cl. ..... 74/665 GE; 74/384; 74/404; 19/159 A; 242/82; 474/88

[58] Field of Search ..... 74/321, 355, 665 GE, 74/404, 384, 318, 319, 329, 354; 242/83, 83; 19/159 A; 474/86, 88

[56] References Cited

U.S. PATENT DOCUMENTS

| | | | |
|---|---|---|---|
| 1,122,223 | 12/1914 | Wearne | 74/354 |
| 1,185,717 | 6/1916 | Roberts | 74/354 |
| 1,481,706 | 1/1924 | Goodwin | 74/321 |
| 1,495,427 | 5/1924 | Nepp | 74/321 |
| 1,858,996 | 1/1932 | Lesage | 74/354 |
| 1,973,348 | 9/1934 | Kooistra | 474/86 |
| 2,391,406 | 12/1945 | Fuglie et al. | 74/321 |
| 2,428,142 | 9/1947 | Carter | 474/88 |
| 2,431,149 | 5/1945 | Sylvander | 74/354 |
| 2,506,562 | 5/1950 | Wait | 74/354 |
| 2,571,880 | 10/1951 | Hinson | 19/159 A |
| 2,795,965 | 6/1957 | Hinton | 74/355 |
| 2,978,923 | 4/1961 | Carlson | 74/355 |
| 3,028,637 | 4/1962 | Van Deusen | 19/159 A |
| 3,134,144 | 5/1964 | Still | 19/159 A |
| 3,241,385 | 3/1966 | Tomaro, Jr. | 74/354 |
| 3,387,436 | 6/1968 | Kasper | 74/404 |
| 3,487,707 | 1/1970 | Kortan | 74/384 |
| 3,670,981 | 6/1972 | Cavella | 74/354 |
| 4,363,185 | 12/1982 | Masubuchi | 74/329 |

FOREIGN PATENT DOCUMENTS

| | | | |
|---|---|---|---|
| 0140532 | 4/1903 | Fed. Rep. of Germany . | |
| 0744890 | 12/1953 | Fed. Rep. of Germany . | |
| 0903873 | 2/1954 | Fed. Rep. of Germany | 74/355 |
| 1292049 | 11/1969 | Fed. Rep. of Germany . | |
| 1650786 | 2/1970 | Fed. Rep. of Germany | 74/319 |
| 3110440 | 10/1982 | Fed. Rep. of Germany . | |
| 3403348 | 8/1985 | Fed. Rep. of Germany | 474/86 |
| 0761488 | 1/1934 | France | 74/355 |
| 0817007 | 5/1937 | France . | |
| 0920405 | 1/1947 | France | 74/354 |
| 0154547 | 9/1982 | Japan | 74/354 |

*Primary Examiner*—Leslie A. Braun
*Assistant Examiner*—Harold F. Macris
*Attorney, Agent, or Firm*—Shefte, Pinckney & Sawyer

[57] ABSTRACT

A device for driving a rotatable can plate of a spinning preparation machine. The device includes a drive gear, a driven gear engaged by and driven by the drive gear for rotation in a direction opposite to the direction of rotation of the drive gear, an intermediate gear mounted on a lever pivotable about an axis spaced from the axis of the intermediate gear for pivotal movement of the intermediate gear between selective alternate positions for engagement with the drive gear or the driven gear for selective driving of the intermediate gear in opposite directions of rotation, a pair of spaced pulleys driven by a belt trained around a drive pulley fixed upon the intermediate gear for transmitting the rotation of the intermediate gear to the pair of spaced pulleys, and can plate pulleys each driven by a belt trained around one of the pulleys of the pair of spaced pulleys for transmitting the rotation of the pair of pulleys to the can plate pulleys.

12 Claims, 2 Drawing Sheets

10
20
21
22
23
24
25
30
31
32
33
34
35
40
41
42
48
50
51
54
57
60
61
65
66
43
16
12
14

40
41
42
45
46
48
40
54
53
61
60
58
12
50
43
44
51
55
62

DEVICE FOR DRIVING A CAN PLATE OF A SPINNING PREPARATION MACHINE

BACKGROUND OF THE INVENTION

The present invention relates to the drive of can plates of a spinning preparation machine, and more particularly to a drive for at least one can plate of a spinning preparation machine which comprises gearing for selectively driving the can plate in alternate directions of rotation.

In the operation of spinning preparation machines, some sliver materials can best be processed if the can in which the sliver is coiled is rotated in the same direction as the sliver feed, such as from the revolving plate of a coiling mechanism, whereas the processing of other sliver materials is best achieved by rotation of the can in a direction opposite the motion of sliver feed. In conventional coiling mechanisms, the revolving plate, from which sliver is coiled into a can, and the can plate, on which the can is supported for rotation, are normally driven by a common motor and since the revolving plate can usually be operated in only one direction of rotation due to the asymmetric design of the feed to the mechanism, the direction of rotation of the can plate needs to be reversible in order to provide selective rotation in opposite directions. To provide for this conventional spinning preparation machines incorporate a drive for the can plate with a transmission with gears which must be exchanged in order to reverse the direction of rotation. Conventional spinning preparation machines thus require relatively expensive assemblies which can be rather burdensome to alter for reversal of the direction of rotation of the can plate.

The objective of the present invention is to provide a drive for a can plate of a spinning preparation machine that is simple and inexpensive, and with which the direction of rotation of the can plate can be easily reversed.

SUMMARY OF THE INVENTION

The present invention provides a device for driving at least one can plate of a spinning preparation machine with provision for selective alternate driving in opposite directions of rotation.

The device is incorporated in a conventional drawing frame for processing of sliver materials by rotating can plates on which roving cans are supported. The device provides for alternate driving of the can plates in either direction of rotation selectively as required to best suit the particular characteristics of the sliver material being processed. Similarly, the device can be utilized in coiling slubbing from a slubber or other types of textile strands from other spinning preparation machines.

Briefly described, the device of the present invention includes a drive gear, driven gear engaged by and driven by the drive gear for rotation in a direction opposite to the direction of rotation of the drive gear, an intermediate gear, means mounting the intermediate gear for selective alternate engagement with the drive gear or the driven gear for selective driving of the intermediate gear in opposite directions of rotation, and means for transmitting the rotation of the intermediate gear to the can plate for rotation thereof. Preferably, the mounting means incorporates a lever upon which the intermediate gear is mounted for selective alternate positioning in either engagement with the drive gear for rotation of the intermediate gear in one direction of rotation or with the driven gear for rotation of the intermediate gear in the opposite direction of rotation. The reversal of the direction of rotation of the can plate is therefore possible with the present invention by simply positioning the lever and intermediate gear therewith as described, eliminating the burdensome and costly disassembly and reassembly of gearing replacement necessary to reverse can rotation with conventional spinning preparation machines.

The intermediate gear preferably includes a drive pulley fixed thereon and the rotation transmitting means includes a drive belt trained around the drive pulley of the intermediate gear. The drive pulley drives the belt which in turn drives a pulley means. The pulley means is disposed in relation to the drive pulley so that the length of the belt from the pulley means to the drive pulley and back to the pulley means when the intermediate gear is in engagement with the drive gear is the same as the length of the belt from the pulley means to the drive pulley and back to the pulley means when the intermediate gear is in engagement with the driven gear. This same drive belt length allows the Use of the same drive belt in both positions without any additional compensating pulleys or guides and without any disassembly and reassembly or exchange of drive belts.

In the preferred embodiment, the pulley means includes a pair of spaced pulleys with the drive belt extending from one pulley of the pair of spaced pulleys to the drive pulley and from the drive pulley to the other of the pair of spaced pulleys. The length of the drive belt similarly is equal in both positions of engagement of the intermediate gear with either the drive gear or the driven gear.

Also, in the preferred embodiment, the lever upon which the intermediate gear is mounted is pivotable about an axis spaced from the axis of the intermediate gear and generally parallel thereto. Pivotal movement of the lever about its axis therefore pivotally moves the intermediate gear from the drive gear engaging position to the driven gear engaging position. The drive pulley and the pair of spaced pulleys are preferably positioned in a configuration forming a triangle with the drive belt being trained around the drive pulley and around the pair of spaced pulleys. Each of the pulleys of the pair of pulleys includes a means connected thereto for transmitting rotation to at least one can plate for rotation thereof. This triangular configuration, however, makes possible the drive of two can plates as well as the reversal of their direction of rotation. The means connected to each of the pulleys of the pair of pulleys preferably includes a pair of drive belts and a pulley on each of the can plates. One of the pair of belts is trained around one of the pulleys of the pair of spaced pulleys and around one of the can plate pulleys, and the other belt of the pair of belts is trained around the other of the pulleys of the pair of spaced pulleys and around the other can plate pulley.

In the preferred embodiment, the axis of the intermediate gear in each of its gear engaging positions is in a Thales circle with respect to a straight line extending between the axis of the lever and the axis of the respective drive and driven gear being engaged by the intermediate gear. This relationship results in substantially parallel intermeshing of the teeth of the intermediate gear and the respective drive or driven gear being engaged during the exchange of positions of engagement.

This permits rapid alternation of the direction of rotation of the can plates with little effort.

Other and further features and advantages of the present invention will be apparent from the accompanying drawings and the following description of the preferred embodiment.

DETAILED DESCRIPTION OF THE PREFERRED EMBODIMENT

Figure 1:
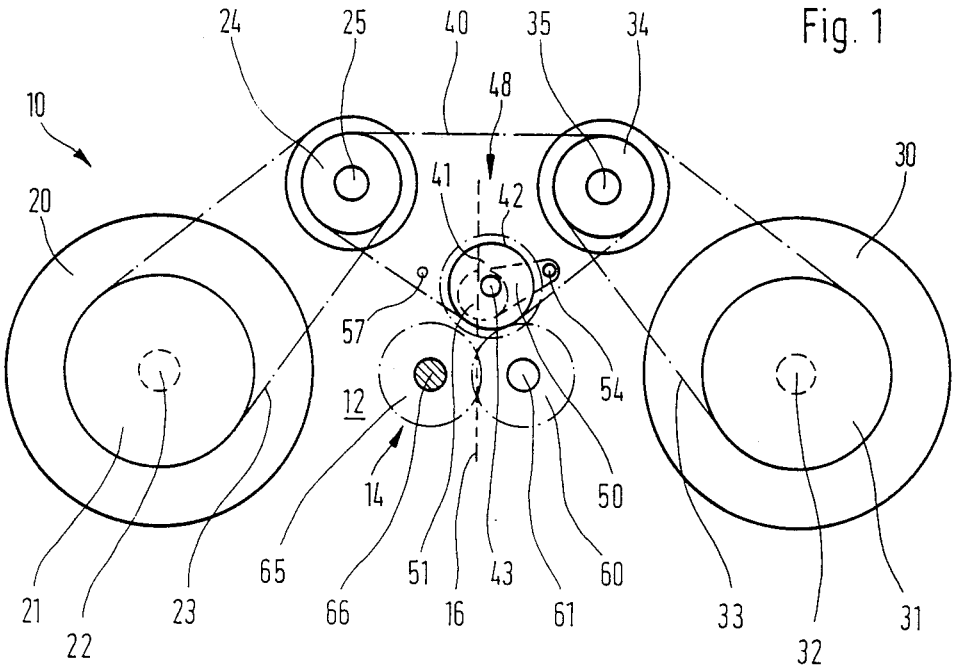
FIG. 1 is a schematic plan view of a sliver can drive incorporating the device of the preferred embodiment of the present invention.

Referring now to the accompanying drawings, the device 10 of the present invention, as illustrated in schematic fashion in FIG. 1, is incorporated in a conventional drawing frame, the details of which are not shown, for processing of sliver material by rotating can plates 20, 30, on which roving cans are supported. The device 10 provides for alternative driving of the can plates in either direction of rotation selectively to best suit the particular characteristics of the sliver material being processed. Similarly, the device can be utilized in coiling slubbing from a slubber for other types of textile strands from other spinning preparation machines.

The drive device 10 includes a gearing mechanism 14 for selective rotation of the can plates 20,30 in alternate directions of rotation, a pair of spaced pulleys 24,34 driven by a drive belt 40 coupled to the gearing mechanism 14 for transmitting rotation to each pulley of the pair of pulleys 24,34 and means connected to each pulley of the pair of pulleys 24,34 for transmitting rotation to the can plates 20,30. The rotation transmitting means connected to each of the pulleys of the pair of pulleys 24,34 includes a pair of belts 23,33 and a can plate pulley 21,31 on each of the can plates 20,30. The can plates 20,30 are each fixed coaxially to the can plate pulleys 21,31, whereby the axes of the can plates 20,30 and the axes 22,32 of the can plate pulleys 21,31 are positioned vertically with the can plate 20,30 and can plate pulleys 21,31 being rotatably mounted on a common base plate 12. The pair of spaced pulleys 24,34 are disposed in spaced relation from the can plates 20,30 and are also mounted on the common base plate 12. The can plate pulleys 21,31 and the pair of spaced pulleys 24,34 are each respectively coupled by one belt of the pair of belts 23,33 which is trained around each one of the pulleys of the pair of pulleys 24,34 and around each one of the can plate pulleys 21,31. Preferably, each of the can plate pulleys 21,31 is equal in diamater, and each of the pulleys of the pair of spaced pulleys 24,34 is equal in diameter with each can plate pulley 21,31 being the same distance from its respective spaced pulley 24,34 so that the pair of belts 23,33 will have the same length and also will drive the can plate pulleys 21,31 at the same rotational speed.

Figure 4:
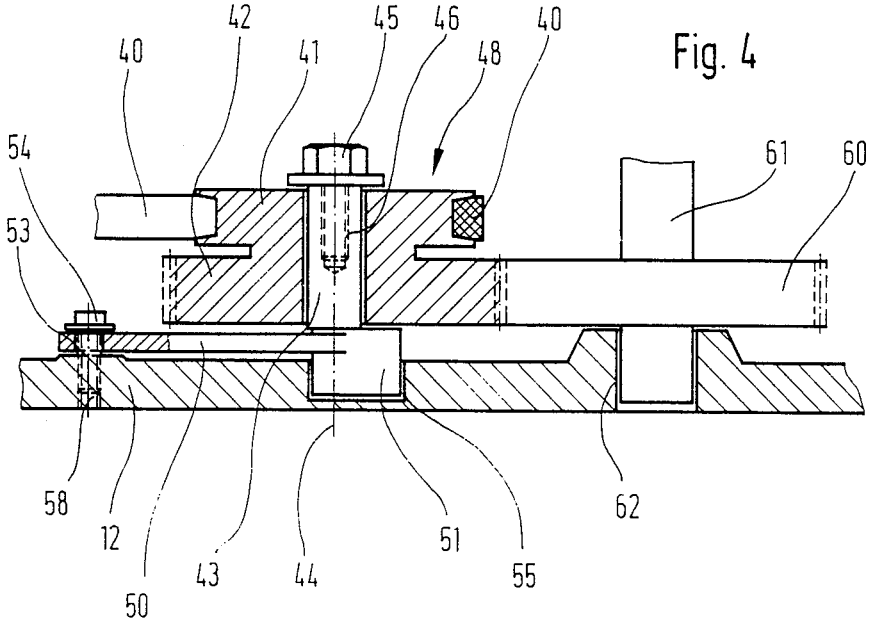
FIG. 4 is an enlarged vertical sectional view of the device of FIGS. 1–3 taken along line IV–IV of FIG. 2.

The gearing mechanism 14 is located approximately centrally between the can plates 20,30, and includes a drive gear 65 driven by a motor and a driven gear 60 engaged with and driven by the drive gear 65. An intermediate gear 42, including a drive pulley 41 fixed thereon, is provided with the combination of the two elements being indicated generally at 48 in FIG. 1. The gears of the gearing mechanism 14 are horizontally positioned for rotation about vertical axes and rotatably mounted on the common base 12. The drive pulley 41 and the pair of spaced pulleys 24,34 are positioned in a configuration forming a triangle with the drive belt 40 being trained around the drive pulley 41 and around the pair of spaced pulleys 24,34 to define a means for transmitting rotation of the intermediate gear 42 to the can plates 20,30 for rotation thereof. The intermediate gear 42 is mounted on a mounting means defined by a pivotable lever 50 for pivoting the intermediate gear 42 from one position for engagement with the drive gear 65 to another position for engagement with the driven gear 60. Referring to FIG. 4, the intermediate gear 42 and drive pulley 41 are integrally formed and mounted on a rotary axle 43 by a screw 45 threadedly received in a hole 46 in the axle 43. The longitudinal central axis of rotary axle 43 and, therefore, of the intermediate gear 42 and its pulley 41, is designated in FIGS. 2–4 by reference numeral 44. Rotary axle 43 is integrally formed with and projects vertically upwardly from the pivotal lever 50 which, therefore, serves as a means for mounting the intermediate gear 42. Pivotal lever 50 includes a pivot axle 51 about which the lever 50 is pivotable with the central axis 52 of the pivot axle 51 being spaced from the central axis 44 of the rotary axle 43 of the intermediate gear 42. The axle 51 projects vertically downwardly from the lever 50 in a direction opposite to and generally parallel to that of the rotary axle 43 of the intermediate gear 42.

The pivot axle 51 of the pivotable lever 50 is inserted into a recess 55 in the common base plate 12 so that the pivotable lever 50 and therewith the intermediate gear 42 can be pivoted about pivot axis 52. As previously described, there are two positions into which provide lever 50 may be pivoted in which positions it can be releasably secured by a screw 54 to the common base plate 12 for positioning the intermediate gear 42 in engagement with the drive gear 65 or the driven gear 60. The screw 54 projects through a hole 53 near the end of the pivotable lever 50 opposite the pivot axle 51 for threadable securement in holes 57,58 formed in the base plate 12 to secure the lever 50 and intermediate gear 42 in either operating position.

The driven gear 60 has an axle 61 projecting downwardly therefrom and rotatably mounted in a recess 62 of the base plate 12 to provide for rotation of the driven gear 60. As previously mentioned, the drive gear 65 is fixed to the output shaft 66 of a motor which projects vertically upwardly for supporting and rotatably driving the drive gear 65 in driving meshing engagement with the driven gear 60. The drive gear 65 engages the driven gear 60 at all times and drives the driven gear 60 for rotation in a direction opposite to the direction of rotation of the drive gear 65. In order to achieve approximately the same relative speed of the can plates 20,30 to the exit opening of the revolving plate, which rotates in only one direction, in the alternate opposite direction of rotation of the can plates 20,30, the number of teeth of the drive gear 65 and the driven gear 60 running in countermotion to each other may be different, which may require a difference in diameter of the gears to provide a common tooth pitch for meshing with the intermediate gear 42.

Figure 2:
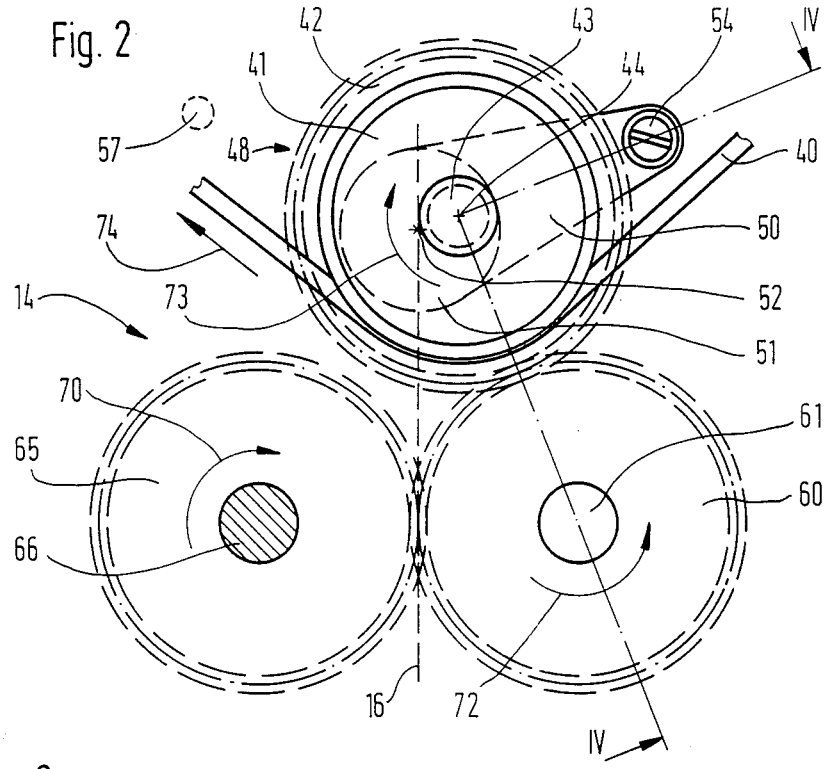
FIGS. 2 and 3 are enlarged plan views of the arrangement of the drive, driven and intermediate gears of the device of FIG. 1 showing the intermediate gear in alternate operation positions.
Figure 3:
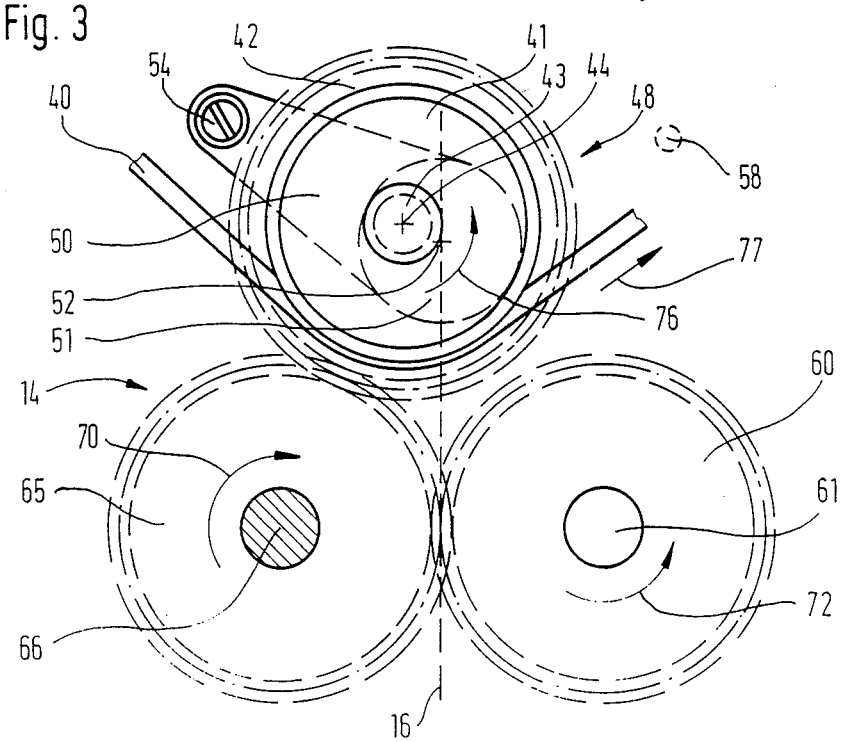

FIGS. 2,3 illustrate the alternate operating positions of the intermediate gear 42. Referring to FIG. 2, the pivotable lever 50 is seen pivoted into position for the intermediate gear 42 to be in engagement with the driven gear 60. In this position of engagement between the intermediate gear 42 and the driven gear 60, the drive pulley 41 will impart motion to the drive belt 40 in arrow direction 74, and the drive belt 40 will in turn impart rotation to the pair of spaced pulleys 24,34. The directions of rotation of the driven gear 60 and the drive gear 65 are designated in FIG. 2 by arrows 72,70, and the direction of rotation of intermediate gear 42 is designated by arrow 73.

Referring now to FIG. 3, the pivotable lever 50 is seen pivoted into position for the intermediate gear 42 to be in engagement with the drive gear 65. In this position of engagement between the intermediate gear 42 and the drive gear 65, the drive pulley 41 will impart motion to the drive belt 40 in arrow direction 77, and the drive belt 40 will in turn impart rotation to the pair of spaced pulleys 24,34. The direction of rotation of the intermediate gear 42 is designated by arrow 76 in FIG. 3, and the direction of rotation of the driven gear 60 and of the drive gear 65 are designated in FIG. 3 by arrows 72,70.

Comparing FIGS. 2 and 3, the direction of travel of the belt 40 indicated by arrow 74 when the intermediate gear 42 is in engagement with the driven gear 60 in FIG. 2 is opposite to the direction of travel of the belt 40 indicated by arrow 77 when the intermediate gear 42 is in engagement with the drive gear 65 in FIG. 3. The pair of spaced pulleys 24,34 will then alternately rotate in opposite directions when the lever 50 is pivoted about its axis 52 for pivotal movement of the intermediate gear 42 between the drive gear engaging position illustrating in FIG. 3 and the driven gear engaging position illustrated in FIG. 2.

As previously described, a means is connected to each of the pulleys 24,34 of the pair of pulleys 24,34 for transmitting rotation to the can plates 20,30 for rotation thereof. This means is defined by the pair of belts 23,33 and the can plate pulleys 21,31 on each of said can plates 20,30. One of the belts of the pair of belts 23,33 is trained around one of the pulleys of the pair of spaced pulleys 24,34 and around one of the can plate pulleys 21,31 and the other belt 23,33 is trained around the other pulley 24,34 and around the other can plate pulley 21,31 for transmission of rotation from the pair of pulleys 24,34 to the can plates 20,30.

The axis 51 of the pivotable lever 50 lies generally in the plane 16 of the common tangent of the drive gear 65 and the driven gear 60. This common tangential plane 16 is located between the axes 25,45 of rotation of the pair of spaced pulleys 24,34 and is generally equidistant therefrom. The location of the axis 44 of the intermediate gear 42 in one position of engagement is generally in a symmetrically opposite angular location with respect to the common tangent plane 16 and the lever pivot axis 56 as the axis 44 of the intermediate gear 42 in the other position of engagement. Thus, the pair of spaced pulleys 24,34 are disposed in relation to the drive pulley 41 of the intermediate gear 42 so that the length of the belt 40 from one pulley of the pair of pulleys to the drive pulley 41 and from the drive pulley 41 to the other pulley of the pair of pulleys when the intermediate gear 42 is in engagement with the drive gear 65 is the same as the length of the belt 40 from the drive pulley 41 to each pulley of the pair of pulleys when the intermediate gear 42 is in engagement with the driven gear 60.

The relationship between the axis 44 of the intermediate gear 42 and the axis 52 of the pivotable lever 50 is further characterized in that the axis 44 of the intermediate gear 42 in each of the drive gear 65 and driven gear 60 engaging positions is in a Thales circle with respect to a straight line extending between the axis 52 of the lever 50 and the axis of the axles 61,66 of the respective driven gear 60 or drive gear 65 being engaged by the intermediate gear 42.

The axis 44 of rotary axle 43 of the intermediate gear 42 is spaced from the axis 52 of pivot axle 51 of pivotable lever 50 and is parallel thereto. This spacing of the axes permits the intermediate gear 42 to engage either the drive gear 65 or the driving gear 60 without losses in wear to the gears in moving into either position of engagement.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A device for driving at least one rotatable can plate of a spinning preparation machine, said device comprising a drive gear, a driven gear engaged and driven by said drive gear for rotation in a direction opposite to the direction of rotation of the drive gear, an intermediate gear, a pulley fixed to said intermediate gear, means mounting said intermediate gear for selective alternate engagement with said drive gear and said driven gear for selective driving of said intermediate gear in opposite directions, and means for transmitting the rotation of said intermediate gear to said at least one can plate for rotation thereof, said rotation transmitting means including a drive belt trained around said drive pulley of said intermediate gear and driven thereby and pulley means driven by said drive belt, said pulley means being disposed in relation to said drive pulley so that the length of said belt from said pulley means to said drive pulley and back to said pulley means when said intermediate gear is in engagement with said drive gear is the same as the length of said belt from said pulley means to said drive pulley and back to said pulley means when said intermediate gear is in engagement with said driven gear.

2. A device according to claim 1 and characterized further in that said pulley means includes a pair of spaced pulleys with said drive belt extending from one pulley of said pair to said drive pulley and from said drive pulley to the other of said pair of spaced pulleys.

3. A device according to claim 1 and characterized further in that said mounting means includes means for pivoting said intermediate gear from one position for engagement with said drive gear to another position for engagement with said driven gear.

4. A device according to claim 3 and characterized further in that said intermediate gear rotates about an axis, said mounting means includes a lever upon which said intermediate gear is mounted, said lever being pivotable about an axis spaced from said axis of said intermediate gear for pivotal movement of said intermediate gear between said drive gear engaging position and said driven gear engaging position.

5. A device according to claim 4 and characterized further in that said axis of said pivotable lever is generally parallel to said axis of said intermediate gear.

6. A device according to claim 2 and characterized further in that said drive pulley and said pair of spaced pulleys are positioned in a configuration forming a triangle with said drive belt being trained around said drive pulley and around said pair of spaced pulleys and means connected to each of said pulleys of said pair of pulleys for transmitting rotation to said at least one can plate for rotation thereof.

7. A device according to claim 6 and characterized further in that said means connected to each of said pulleys of said pair of pulleys includes a pair of belts and a can plate pulley on each of said can plates, one of said pair of belts being trained around one of said pulleys of said pair of pulleys and around one of said can plate pulleys and the other belt of said pair of belts being trained around the other of said pulleys of said pair of pulleys and around another of said can plate pulleys.

8. A device according to claim 4 and characterized further in that said axis of said pivotable lever is generally in the plane of the common tangent of said drive gear and said driven gear, the location of said axis of said intermediate gear in one of said engaging positions is generally in a symmetrically opposite angular location with respect to said common tangent plane and said axis of said pivot lever as said axis of said intermediate gear in the other of said engaging positions.

9. A device according to claim 8 and characterized further in that said drive gear and said driven gear each rotate about an axis and said axis of said intermediate gear in each of said gear engaging positions is in a Thales circle with respect to a straight line extending between the axis of said lever and the axis of the respective drive and driven gear being engaged by said intermediate gear.

10. A device according to claim 9 and characterized furhter in that said lever, said drive gear, said driven gear, said pulley means and said at least one can plate are mounted on a common base.

11. A device according to claim 10 and characterized further in that said pulley means includes a pair of spaced pulleys mounted on said common base with said drive belt extending from one pulley of said pair to said drive pulley and from said drive pulley to the other of said pair of spaced pulleys.

12. A device according to claim 10 and characterized further by means for releasably securing said lever to said base in position to position said intermediate gear alternately in said drive gear and said driven gear engaging positions.

* * * * *